US008993914B2

(12) United States Patent
Kujacznski et al.

(10) Patent No.: US 8,993,914 B2
(45) Date of Patent: Mar. 31, 2015

(54) HIGH-SPEED, HIGH-RESOLUTION, TRIANGULATION-BASED, 3-D METHOD AND SYSTEM FOR INSPECTING MANUFACTURED PARTS AND SORTING THE INSPECTED PARTS

(71) Applicant: GII Acquisition, LLC, Davisburg, MI (US)

(72) Inventors: Nathan Andrew-Paul Kujacznski, Flint, MI (US); Michael G. Nygaard, Fenton, MI (US)

(73) Assignee: GII Acquisition, LLC, Davisburg, MI (US)

( * ) Notice: Subject to any disclaimer, the term of this patent is extended or adjusted under 35 U.S.C. 154(b) by 0 days.

(21) Appl. No.: 14/221,410

(22) Filed: Mar. 21, 2014

(65) Prior Publication Data

US 2014/0346095 A1 Nov. 27, 2014

Related U.S. Application Data

(63) Continuation-in-part of application No. 13/901,868, filed on May 24, 2013.

(51) Int. Cl.
*B07C 5/00* (2006.01)
*B07C 5/34* (2006.01)

(52) U.S. Cl.
CPC ..... *B07C 5/34* (2013.01)
USPC ..... 209/576; 209/577; 209/579; 209/587; 209/588; 209/589; 345/49; 356/602; 250/559.23

(58) Field of Classification Search
USPC ..... 209/576, 577, 587, 588, 589; 345/49; 356/602; 250/559.23
See application file for complete search history.

(56) References Cited

U.S. PATENT DOCUMENTS

| | | | |
|---|---|---|---|
| 2,645,343 | A | 7/1953 | Nemir |
| 3,924,953 | A | 12/1975 | Allard |
| 4,315,688 | A | 2/1982 | Pryor |
| 4,547,674 | A | 10/1985 | Pryor et al. |

(Continued)

FOREIGN PATENT DOCUMENTS

| | | | |
|---|---|---|---|
| WO | 2005022076 | A2 | 3/2005 |
| WO | 2009130062 | A1 | 10/2009 |

OTHER PUBLICATIONS

International Search Report and Written Opinion; International application No. PCT/US2014/018663; date of mailing May 28, 2014.

*Primary Examiner* — Terrell Matthews
(74) *Attorney, Agent, or Firm* — Brooks Kushman P.C.

(57) ABSTRACT

A high-speed, high-resolution, triangulation-based, 3-D method and system for inspecting manufactured parts and sorting the inspected parts are provided. The method includes consecutively transferring the parts so that the parts move along a path which extends from a supply of parts and through an imaging station. A triangulation-based sensor head is supported at the imaging station. The sensor head is configured to generate focused lines of radiation and to sense corresponding reflected lines of radiation. The focused lines are delivered onto an end surface of each part to obtain a corresponding array of reflected lines of radiation. The sensor head senses the array of reflected lines to obtain a corresponding set of 2-D profile signals. The set of profile signals represent a 3-D view of the end surface. The set of 2-D profile signals of each part is processed to identify parts having an unacceptable defect.

20 Claims, 8 Drawing Sheets

(56) References Cited

U.S. PATENT DOCUMENTS

| | | | | |
|---|---|---|---|---|
| 4,598,998 | A | 7/1986 | Kamei et al. | |
| 4,644,394 | A | 2/1987 | Reeves | |
| 4,721,388 | A | 1/1988 | Takagi et al. | |
| 4,831,251 | A | 5/1989 | Hanna | |
| 4,852,983 | A | 8/1989 | Fein | |
| 4,906,098 | A | 3/1990 | Thomas et al. | |
| 4,923,066 | A | 5/1990 | Ophir et al. | |
| 4,969,746 | A | 11/1990 | McConnell et al. | |
| 4,970,401 | A | 11/1990 | Sadeh et al. | |
| 4,983,043 | A | 1/1991 | Harding | |
| 5,012,117 | A | 4/1991 | Karafa et al. | |
| 5,024,529 | A | 6/1991 | Svetkoff et al. | |
| 5,098,031 | A | 3/1992 | Hitomi | |
| 5,164,995 | A | 11/1992 | Brooks et al. | |
| 5,168,458 | A | 12/1992 | Gomes | |
| 5,170,306 | A | 12/1992 | Gomes | |
| 5,291,272 | A | 3/1994 | Demirsu | |
| 5,383,021 | A | 1/1995 | Hanna | |
| 5,521,707 | A | 5/1996 | Castore et al. | |
| 5,546,189 | A | 8/1996 | Svetkoff et al. | |
| 5,568,263 | A | 10/1996 | Hanna | |
| 5,608,530 | A | 3/1997 | Gates | |
| 5,617,209 | A | 4/1997 | Svetkoff et al. | |
| 5,646,724 | A | 7/1997 | Hershline | |
| 5,812,269 | A * | 9/1998 | Svetkoff et al. | 356/602 |
| 5,815,275 | A | 9/1998 | Svetkoff et al. | |
| 5,847,382 | A | 12/1998 | Koch et al. | |
| 6,044,623 | A * | 4/2000 | Karaki et al. | 53/430 |
| 6,046,462 | A | 4/2000 | Yokajty et al. | |
| 6,055,329 | A | 4/2000 | Mufti | |
| 6,098,031 | A | 8/2000 | Svetkoff et al. | |
| 6,175,092 | B1 * | 1/2001 | Binette et al. | 209/587 |
| 6,252,661 | B1 | 6/2001 | Hanna | |
| 6,285,034 | B1 | 9/2001 | Hanna et al. | |
| 6,289,600 | B1 | 9/2001 | Watts | |
| 6,313,948 | B1 | 11/2001 | Hanna | |
| 6,646,218 | B1 * | 11/2003 | Campbell et al. | 209/582 |
| 6,959,108 | B1 | 10/2005 | Bartelt et al. | |
| 7,312,607 | B2 | 12/2007 | Nygaard | |
| 7,363,817 | B2 | 4/2008 | Bond et al. | |
| 7,403,872 | B1 | 7/2008 | St. Onge et al. | |
| 7,633,046 | B2 | 12/2009 | Spalding | |
| 7,633,634 | B2 | 12/2009 | Spalding et al. | |
| 7,633,635 | B2 | 12/2009 | Nygaard et al. | |
| 7,684,054 | B2 | 3/2010 | Crowther | |
| 7,738,088 | B2 | 6/2010 | Spalding | |
| 7,738,121 | B2 | 6/2010 | Spalding | |
| 7,755,754 | B2 | 7/2010 | Spalding | |
| 7,777,900 | B2 | 8/2010 | Nygaard et al. | |
| 7,796,278 | B2 | 9/2010 | Spalding et al. | |
| 7,812,970 | B2 | 10/2010 | Nygaard | |
| 7,920,278 | B2 | 4/2011 | Nygaard | |
| 8,054,460 | B2 | 11/2011 | Agapiou et al. | |
| 8,179,434 | B2 | 5/2012 | Koval et al. | |
| 8,228,493 | B2 | 7/2012 | Yagyu et al. | |
| 8,416,403 | B2 | 4/2013 | Nygaard | |
| 8,570,504 | B2 | 10/2013 | Nygaard | |
| 8,615,123 | B2 | 12/2013 | Dabic | |
| 2005/0174567 | A1 | 8/2005 | Hanna | |
| 2006/0236792 | A1 | 10/2006 | Hanna | |
| 2009/0103107 | A1 | 4/2009 | Nygaard | |
| 2009/0103112 | A1 | 4/2009 | Nygaard | |
| 2010/0201806 | A1 | 8/2010 | Nygaard et al. | |
| 2010/0245850 | A1 | 9/2010 | Lee et al. | |
| 2012/0105429 | A1 | 5/2012 | Nygaard | |
| 2012/0293623 | A1 | 11/2012 | Nygaard | |
| 2012/0293789 | A1 | 11/2012 | Nygaard | |
| 2012/0303157 | A1 | 11/2012 | Chung | |
| 2013/0235371 | A1 | 9/2013 | Nygaard et al. | |
| 2013/0329012 | A1 * | 12/2013 | Bartos et al. | 348/46 |
| 2014/0063509 | A1 | 3/2014 | Nygaard et al. | |
| 2014/0168661 | A1 | 6/2014 | Nygaard et al. | |

* cited by examiner

HIGH-SPEED, HIGH-RESOLUTION, TRIANGULATION-BASED, 3-D METHOD AND SYSTEM FOR INSPECTING MANUFACTURED PARTS AND SORTING THE INSPECTED PARTS

CROSS-REFERENCE TO RELATED APPLICATIONS

This application is a continuation-in-part of U.S. patent application entitled "High-Speed, Triangulation-Based, 3-D Method and System for Inspecting Manufactured Parts and Sorting the Inspected Parts" filed on May 24, 2013 and having U.S. Ser. No. 13/901,868. This application is related to U.S. patent application Ser. No. 13/714,999 filed on Dec. 14, 2012 and Ser. No. 13/901,862 filed on May 24, 2013.

TECHNICAL FIELD

This invention relates, in general, to the field of non-contact, optical inspection and sorting of parts, and, more particularly, to triangulation-based, 3-D methods and systems for optically inspecting and sorting manufactured parts.

OVERVIEW

Traditional manual, gauging devices and techniques have been replaced to some extent by automatic inspection methods and systems. However, such automatic inspection methods and systems still have a number of shortcomings associated with them.

Many parts, such as valve spring retainers, rivets, washers, first draw caps for ammunition, nuts, valve seats and the like develop microscopic surface defects such as slight hollows or depressions made in hard even surfaces by a blow or pressure during the manufacturing process.

Jackets are traditionally produced in cup and draw operations. A shallow cup is formed from a sheet of metal in a cupping press. Dies and punches in the press blank out a disk of the sheet metal and simultaneously form it into a shallow cup. The basic requirements for cups are concentric wall thickness and relatively even tops. The jacket is ultimately trimmed to meet specifications.

A jacket that is not much taller than it is wide (some handgun bullets) can often be used directly from the cupping press if the initial sheet material's thickness is close to the desired jacket thickness. For rifle bullets where the jacket can be two or more times the diameter of the bullet in length, the cup must receive additional processing. This is performed by the draw operation.

In metalworking, drawing a part refers to stretching it under controlled conditions, while reducing the diameter. The control is provided by a die and punch set that maintains constant contact with the jacket walls, ensuring equal stresses at all points on the bullet and controlling concentricity. The draw operation targets the sidewalls of the cup. The resulting part looks like a metal test tube, with a rounded base.

In drawing, several dies may be used in conjunction with one punch. This progressive draw tooling is known as a die stack. The tooling designer must consider the reduction in wall thickness and diameter that the stack must produce. All the dies and the punch must make full contact with the jacket so that no unworked metal remains when the part exits the die stack.

In optical metrology, inter-reflection (i.e., double bounce or secondary reflection) poses a challenge for surface measurement of shiny objects. Due to specular reflections that can occur among concave surfaces or combinations of surfaces positioned near right angles to each other, the true desired laser lines are often obscured by inter-reflection lines. Such obscuration makes it difficult to measure shiny surfaces of complex surface geometry.

Some laser triangulation measuring equipment operates by projecting, with a laser beam having a wavelength centered at approximately 830 nm (infrared (IR) radiation), a light spot having a preset spot size onto the surface to be examined, e.g., from a laser projection "gun" that may be mounted normal to the surface being examined. A light detection unit including a lens and a light detecting element or "camera," such as a CCD or CMOS imaging chip or a position sensing device (PSD), e.g., of silicon, at an offset angle to the projection axis may observe the position of the laser spot in its field of view and output a signal describing the angle at which the spot appeared in the field of view. The range to the object can be computed from the angle information when the distance between the laser projection axis and the light detection unit is known. The offset angle between the laser beam and the line of sight of the light detection unit is often referred to as the "triangulation angle." Based on which part of the detector the light reflected from the imaged object impinges, the height or "z-component" of the object at the point at which the light spot impinges upon the object may be determined.

U.S. Pat. No. 7,403,872 discloses a method and system for inspecting manufactured parts such as cartridges and cartridge cases and sorting the inspected parts.

WO 2005/022076 discloses a plurality of light line generators which generate associated beams of light that intersect a part to be inspected.

U.S. Pat. No. 6,313,948 discloses an optical beam shaper for production of a uniform sheet of light for use in a parts inspection system having a light source including a coherent light generator, a diffractive beam shaper, and lens elements.

U.S. Pat. No. 6,285,034 discloses an inspection system for evaluating rotationally asymmetric workpieces for conformance to configuration criteria.

U.S. Pat. No. 6,252,661 discloses an inspection system for evaluating workpieces for conformance to configuration criteria.

U.S. Pat. No. 6,959,108 discloses an inspection system wherein workpieces to be inspected are consecutively and automatically launched to pass unsupported through the field of view of a plurality of cameras.

U.S. Pat. No. 4,831,251 discloses an optical device for discriminating threaded workpiece by the handedness by their screw thread profiles.

U.S. Pat. No. 5,383,021 discloses a non-contact inspection system capable of evaluating spatial form parameters of a workpiece to provide inspection of parts in production.

U.S. Pat. No. 5,568,263 also discloses a non-contact inspection system capable of evaluating spatial form parameters of a workpiece to provide inspection of parts in production.

U.S. Pat. No. 4,852,983 discloses an optical system which simulates the optical effect of traveling over a large distance on light traveling between reference surfaces.

U.S. Patent Application Publication No. 2005/0174567 discloses a system to determine the presence of cracks in parts.

U.S. Patent Application Publication No. 2006/0236792 discloses an inspection station for a workpiece including a conveyor, a mechanism for rotating the workpiece, and a probe.

U.S. Pat. No. 6,289,600 discloses a non-contact measuring device for determining the dimensions of a cylindrical object, such as a pipe.

U.S. Pat. No. 5,521,707 discloses a non-contact laser-based sensor guided by a precision mechanical system to scan a thread form producing a set of digitized images of the thread form.

WO 2009/130062 discloses a method and a device for the optical viewing of objects.

As described in U.S. Pat. No. 6,098,031, triangulation is the most commonly used 3-D imaging method and offers a good figure of merit for resolution and speed. U.S. Pat. Nos. 5,024,529 and 5,546,189 describe the use of triangulation-based systems for inspection of many industrial parts, including shiny surfaces like pins of a grid array. U.S. Pat. No. 5,617,209 shows a scanning method for grid arrays which has additional benefits for improving accuracy. The method of using an angled beam of radiant energy can be used for triangulation, confocal or general line scan systems. Unfortunately, triangulation systems are not immune to fundamental limitations like occlusion and sensitivity to background reflection. Furthermore, at high magnification, the depth of focus can limit performance of systems, particularly edge location accuracy, when the object has substantial relief and a wide dynamic range (i.e. variation in surface reflectance). In some cases, camera-based systems have been combined with triangulation systems to enhance measurement capability.

U.S. Pat. No. 5,098,031 discloses a method and system for high-speed, 3-D imaging of microscopic targets. The system includes confocal and triangulation-based scanners or subsystems which provide data which is both acquired and processed under the control of a control algorithm to obtain information such as dimensional information about the microscopic targets which may be "non-cooperative." The "non-cooperative" targets are illuminated with a scanning beam of electromagnetic radiation such as laser light incident from a first direction. A confocal detector of the electromagnetic radiation is placed at a first location for receiving reflected radiation which is substantially optically collinear with the incident beam of electromagnetic radiation. The triangulation-based subsystem also includes a detector of electromagnetic radiation which is placed at a second location which is non-collinear with respect to the incident beam. Digital data is derived from signals produced by the detectors.

U.S. Pat. No. 5,815,275 discloses triangulation-based 3-D imaging using an angled scanning beam of radiant energy.

U.S. Pat. Nos. 7,812,970 and 7,920,278 disclose part inspection using a profile inspection subsystem and triangulation.

U.S. Pat. No. 4,547,674 discloses a method and apparatus for inspecting gear geometry via optical triangulation.

U.S. Pat. No. 4,970,401 discloses a non-contact triangulation probe system including a base plate and a first non-contact triangulation probe including a light source mounted on a first movable slide.

U.S. Pat. Nos. 5,168,458 and 5,170,306 disclose methods and systems for gauging threaded fasteners to obtain trilobular parameters.

Other U.S. patent documents related to the invention include: U.S. Pat. Nos. 4,315,688; 4,598,998; 4,644,394; 4,852,983; 4,906,098; 5,521,707; 5,608,530; 5,646,724; 5,291,272; 6,055,329; 4,983,043; 3,924,953; 5,164,995; 4,721,388; 4,969,746; 5,012,117; 7,684,054; 7,403,872; 7,633,635; 7,312,607, 7,777,900; 7,633,046; 7,633,634; 7,738,121; 7,755,754; 7,738,088; 7,796,278; 7,684,054; 8,054,460; 8,179,434; 8,416,403 and U.S. published patent applications 2010/0245850, 2010/0201806, 2012/0293623; and 2012/0293789.

SUMMARY OF EXAMPLE EMBODIMENTS

An object of at least one embodiment of the present invention is to provide a high-speed, high-resolution, triangulation-based, 3-D method and system for precisely inspecting the end surfaces of manufactured parts and sorting the inspected parts at a relatively low cost.

In carrying out the above object and other objects of at least one embodiment of the present invention, a high-speed, high-resolution, triangulation-based, 3-D method of inspecting manufactured parts and sorting the inspected parts is provided. The method includes receiving a supply of parts and consecutively transferring the parts so that the parts move along a path which extends from the supply of parts and through an imaging station. The method also includes supporting a triangulation-based sensor head at the imaging station. The sensor head is configured to generate focused lines of radiation and to sense corresponding reflected lines of radiation. Further, the method includes delivering the focused lines onto an end surface of each part during motion of the parts relative to the focused lines to obtain a corresponding array of reflected lines of radiation. The sensor head senses the array of reflected lines to obtain a corresponding set of 2-D profile signals. The set of profile signals represent a 3-D view of the end surface. The method further includes processing the set of 2-D profile signals of each part to identify parts having an unacceptable defect, directing parts identified as having an unacceptable defect to a defective part area and directing parts not identified as having an unacceptable defect to an acceptable part area.

The method may further include generating control signals to control the sensor head based on the step of transferring.

The sensor head may include at least one semiconductor laser.

The focused lines of radiation may be polarized laser lines of light.

The step of processing may determine a part parameter.

The path may be circular wherein the step of generating is performed with a rotary encoder.

The path may be linear wherein the step of generating is performed with a linear encoder.

The method may further include the step of coordinating the imaging of the parts at the imaging station with the movement of the parts to and from the imaging station to control the movement and the imaging of the parts.

The step of transferring may be at least partially performed with a rotary glass disk or table.

The step of transferring may be at least partially performed with a track having an elongated slit dimensioned to allow the focused and reflected lines of radiation to pass therethrough.

Further, in carrying out the above object and other objects of at least one embodiment of the present invention, a high-speed, high-resolution, triangulation-based, 3-D system for inspecting manufactured parts and sorting the inspected parts is provided. The system includes a source of parts and a transfer subsystem for consecutively transferring the parts from the source of parts so that the parts move along a path which extends from the source of parts and through an imaging station. The system also includes a triangulation-based sensor head located at the imaging station. The sensor head is configured to generate focused lines of radiation and to sense corresponding reflected lines of radiation. The sensor head delivers the focused lines onto an end surface of each part during motion of the parts relative to the focused lines to obtain a corresponding array of reflected lines of radiation. The sensor head senses the array of reflected lines to obtain a corresponding set of 2-D profile signals. The set of profile signals represent a 3-D view of the end surface. The system also includes at least one processor to process the set of 2-D profile signals of each part to identify parts having an unacceptable defect. A mechanism including a part sorter is provided for directing parts identified as having an unacceptable defect to a defective part area and directing parts not identified as having an unacceptable defect to an acceptable part area. A system controller coupled to the at least one processor and the part sorter controls the sorting based on the inspecting.

The system may further include a sensor for providing a control signal at each of a plurality of known intervals of movement of the transfer subsystem. The control signals are utilized to control the sensor head.

The sensor head may include at least one semiconductor laser.

The focused lines of radiation may be polarized laser lines of light.

The at least one processor may determine a part parameter.

The path may be circular wherein the sensor is a rotary sensor.

The path may be linear wherein the sensor is a linear sensor.

The system controller may coordinate the imaging of the parts at the imaging station with the movement of the parts to and from the imaging station to control the movement and the imaging of the parts.

The transfer subsystem may include a rotary glass disk or table.

The transfer subsystem may include a track having an elongated slit dimensioned to allow the focused and reflected lines of radiation to pass therethrough.

Other technical advantages will be readily apparent to one skilled in the art from the following figures, descriptions and claims. Moreover, while specific advantages have been enumerated, various embodiments may include all, some or none of the enumerated advantages.

DETAILED DESCRIPTION OF EXAMPLE EMBODIMENTS

Figure 1:
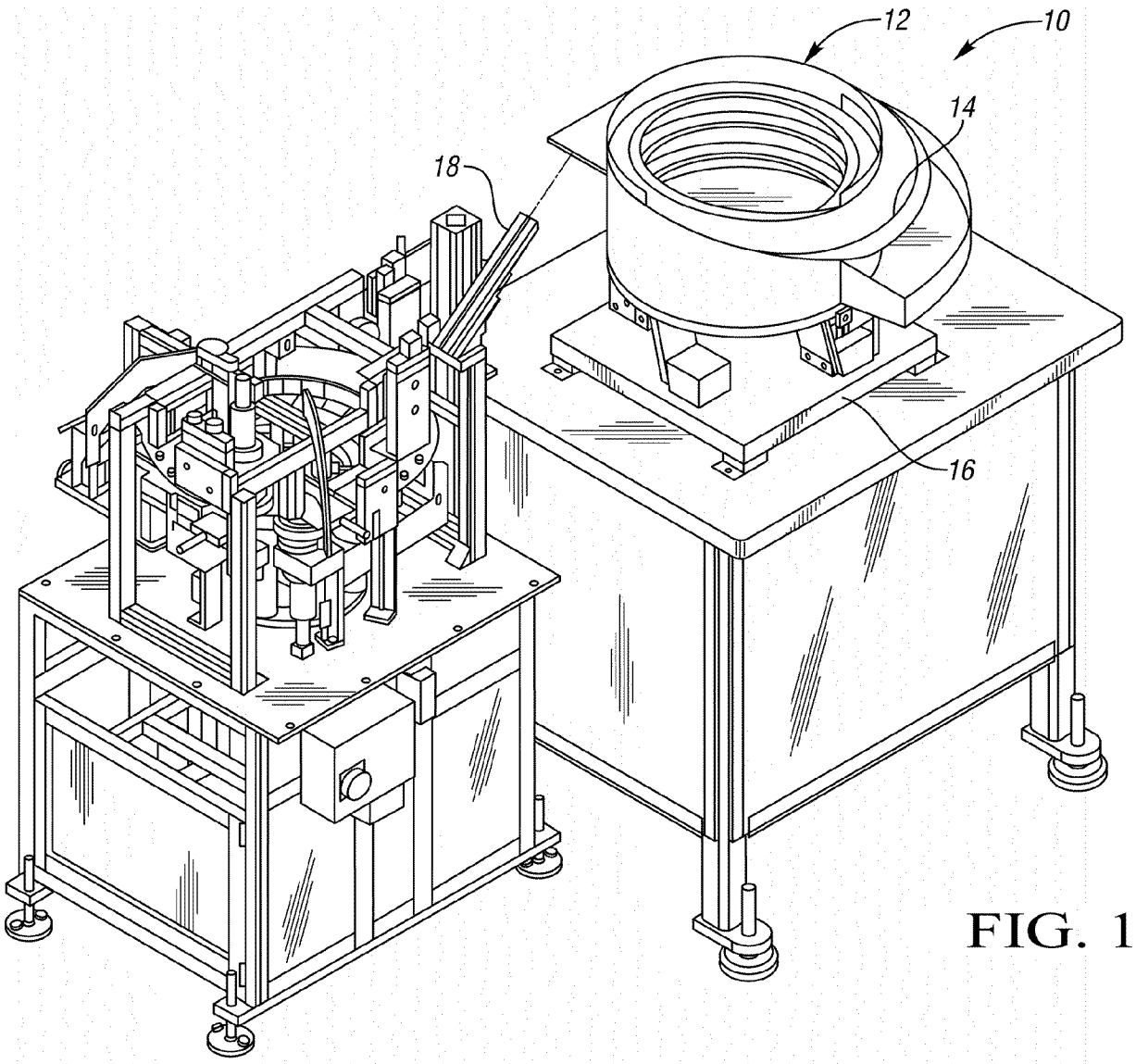
FIG. 1 is a schematic perspective view of a system constructed in accordance with at least one embodiment of the present invention.
Figure 2:
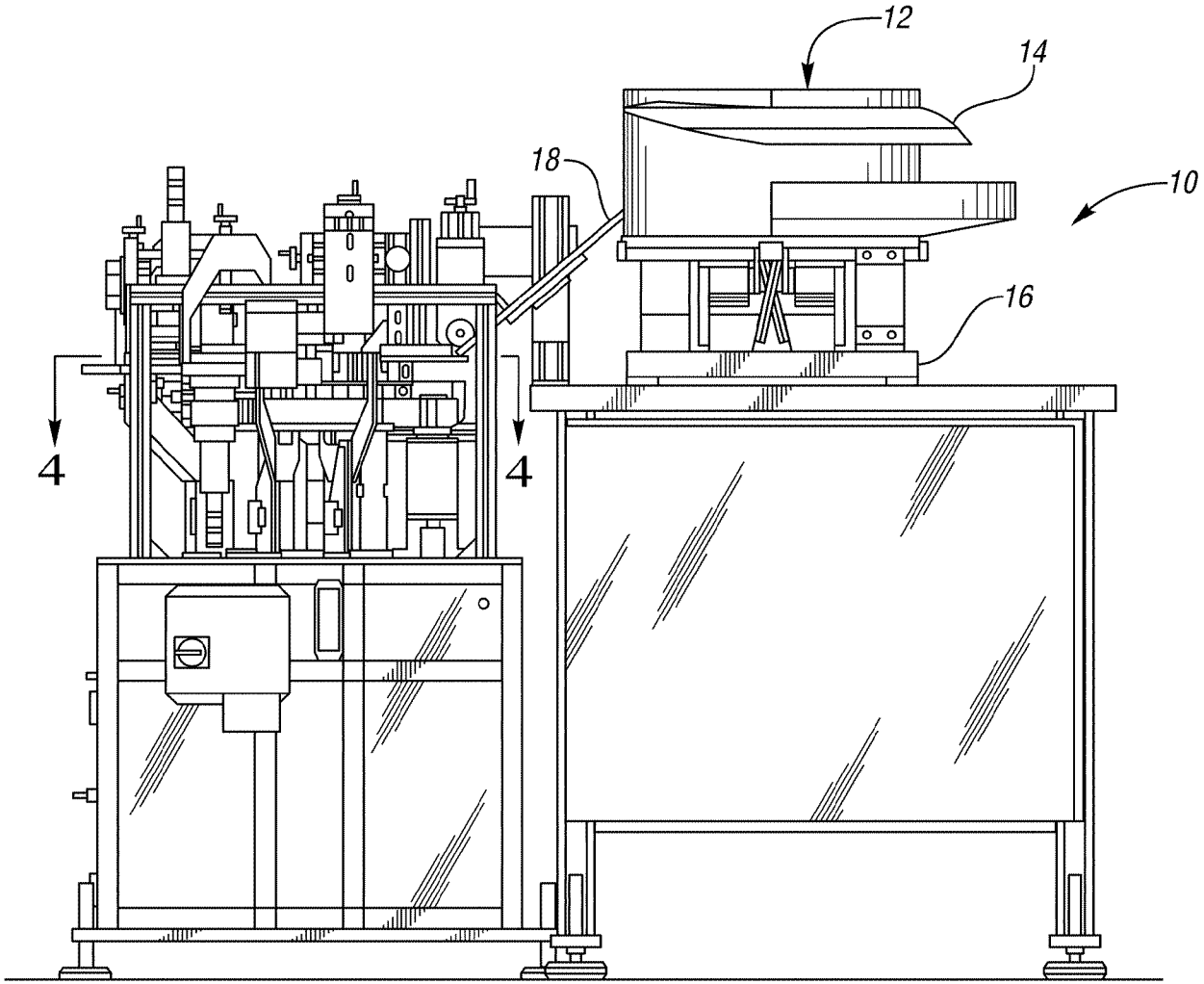
FIG. 2 is a front view of the system of FIG. 1.
Figure 3:
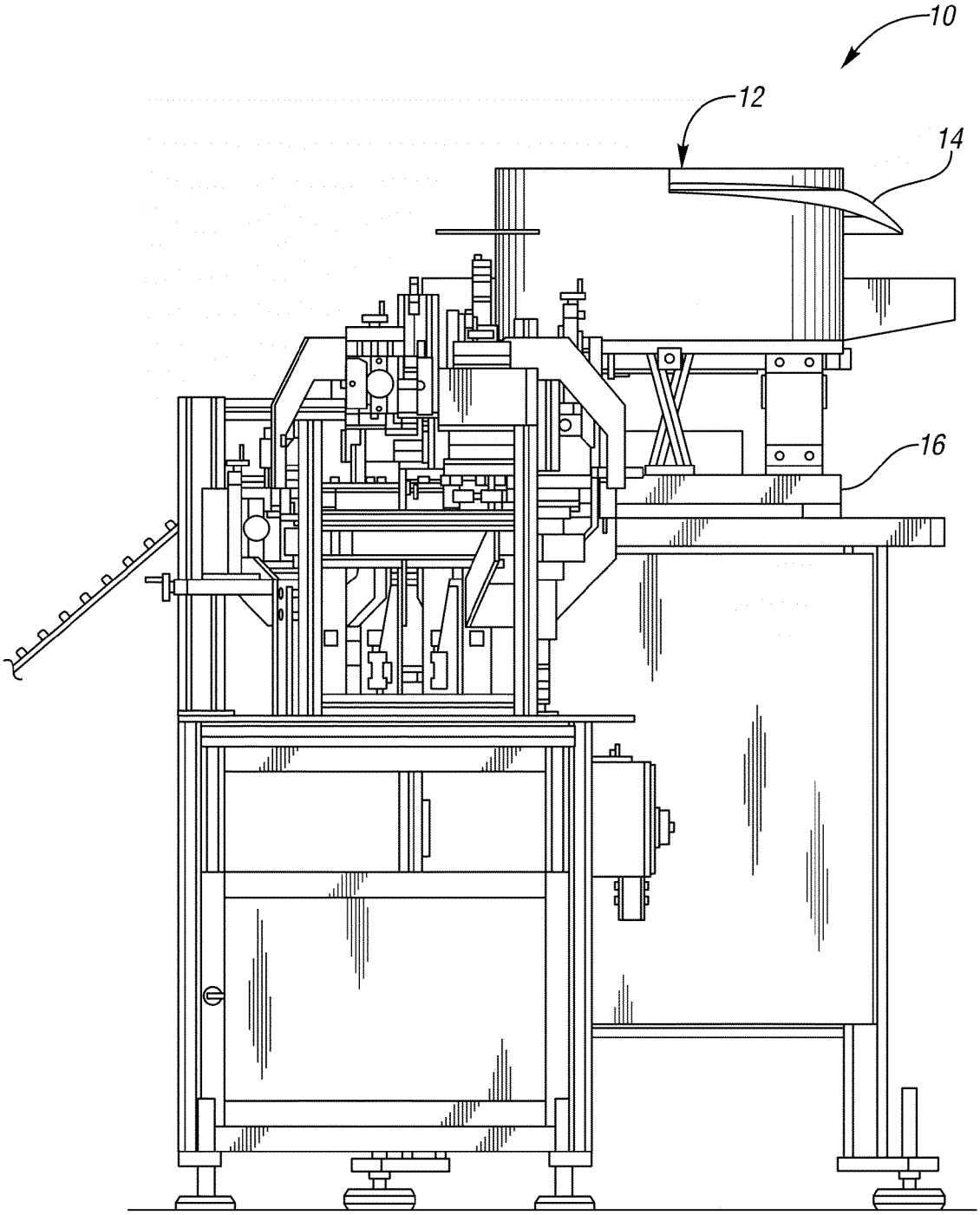
FIG. 3 is a side view of the system of FIG. 1.
Figure 4:
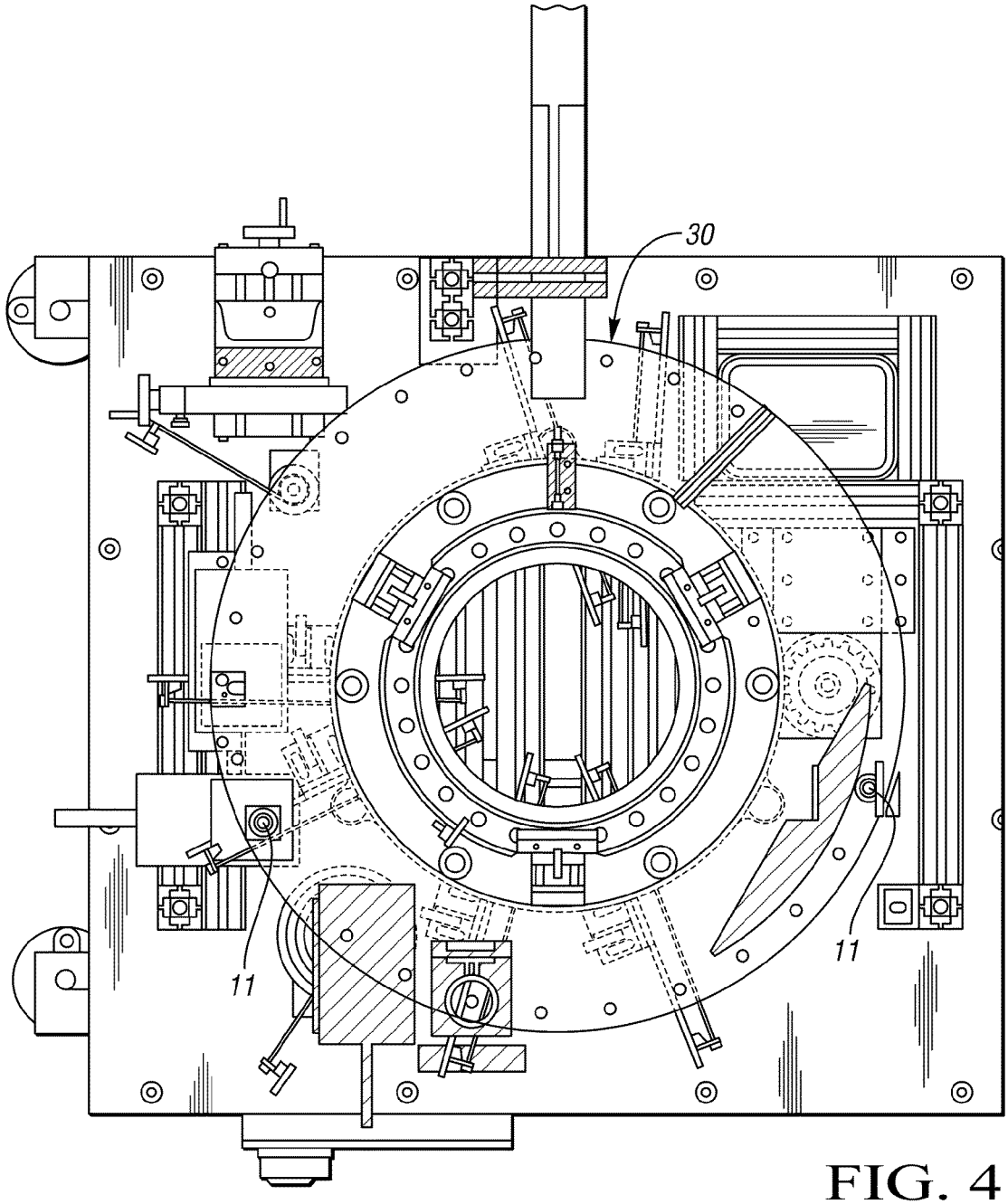
FIG. 4 is a view taken along lines 4-4 of FIG. 2 illustrating various possible stations, including an imaging station, located about a rotary glass disk or table of the system.
Figure 5:
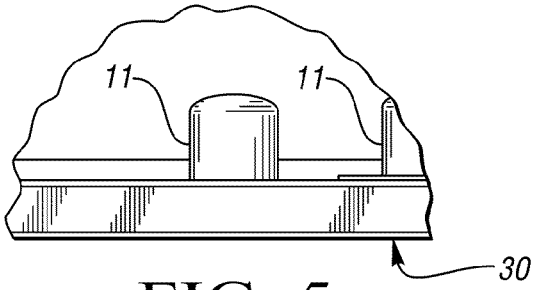
FIG. 5 is a side view of a part such as a first draw cup for ammunition supported on the disk or table of FIG. 4.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

In general, and as described below, at least one embodiment of the present invention provides a high-speed, high-resolution triangulation-based, 3-D method and system for inspecting manufactured parts at one or more imaging stations and sorting the inspected parts. The parts, such as valve seats, washers, valve spring retainers, nuts, first draw caps for ammunition and rivets have top and bottom end surfaces which are optically inspected.

In general, one embodiment of the high-speed, high-resolution, triangulation-based, 3-D method and system of the present invention optically inspects manufactured parts such as the parts illustrated in FIGS. 4 through 9. The inspected parts are then typically sorted based on the inspection(s). The system, generally indicated at 10, is designed for the inspection of one or more outer end surfaces of the parts. The system 10 is suitable for the inspection of small, mass-produced manufactured parts. The subsystems of the system 10 which may be used for part handling and delivery may vary widely from application to application depending on part size and shape, as well as what inspections are being conducted. The subsystems ultimately chosen for part handling and delivery have some bearing on the nature of the subsystems conducting the optical and other non-contact inspection.

Initially, parts, such as first drawn caps 11 (FIGS. 4-7) or valve spring retainers 13 (FIGS. 8-9) are placed into a source of parts such as an orienting feeder bowl 12 having a scalloped rim 14. The bowl 12 is supported on an adjustable frame structure 16. Tooling around the rim 14 takes advantage of the asymmetrical mass distribution of the parts to feed the parts onto a downwardly-sloped feeder conveyor or loader 18. Consequently, every part which exits the bowl 12 is received by the conveyor 18 and is properly oriented. One or more vibrators (not shown) controlled by a vibrator controller (not shown) vibrate the bowl 12 to help move the parts in single file to a loading station.

Figure 6:
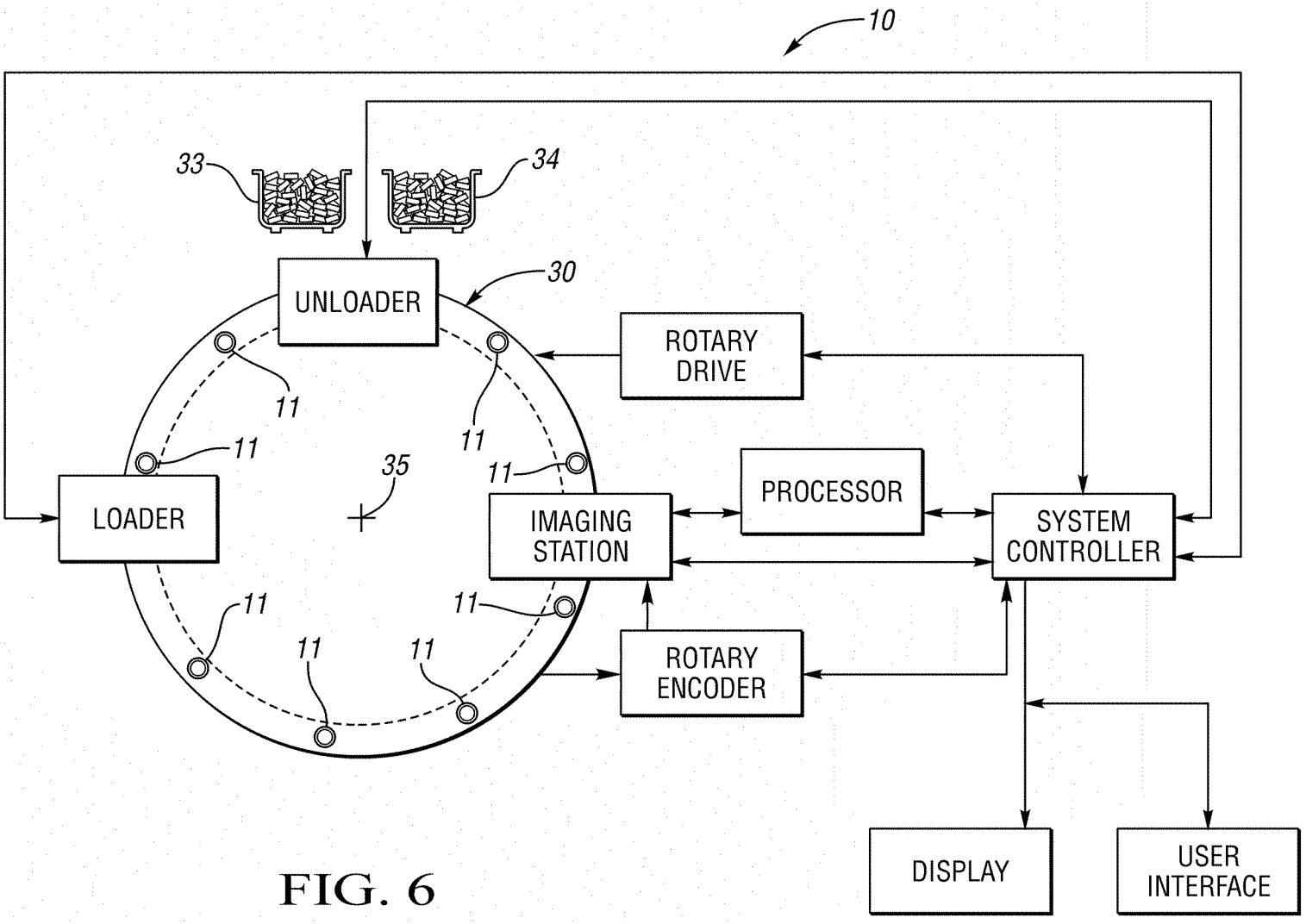
FIG. 6 is a schematic block diagram of the system of FIG. 1 including a top imaging station with a control system.
Figure 7:
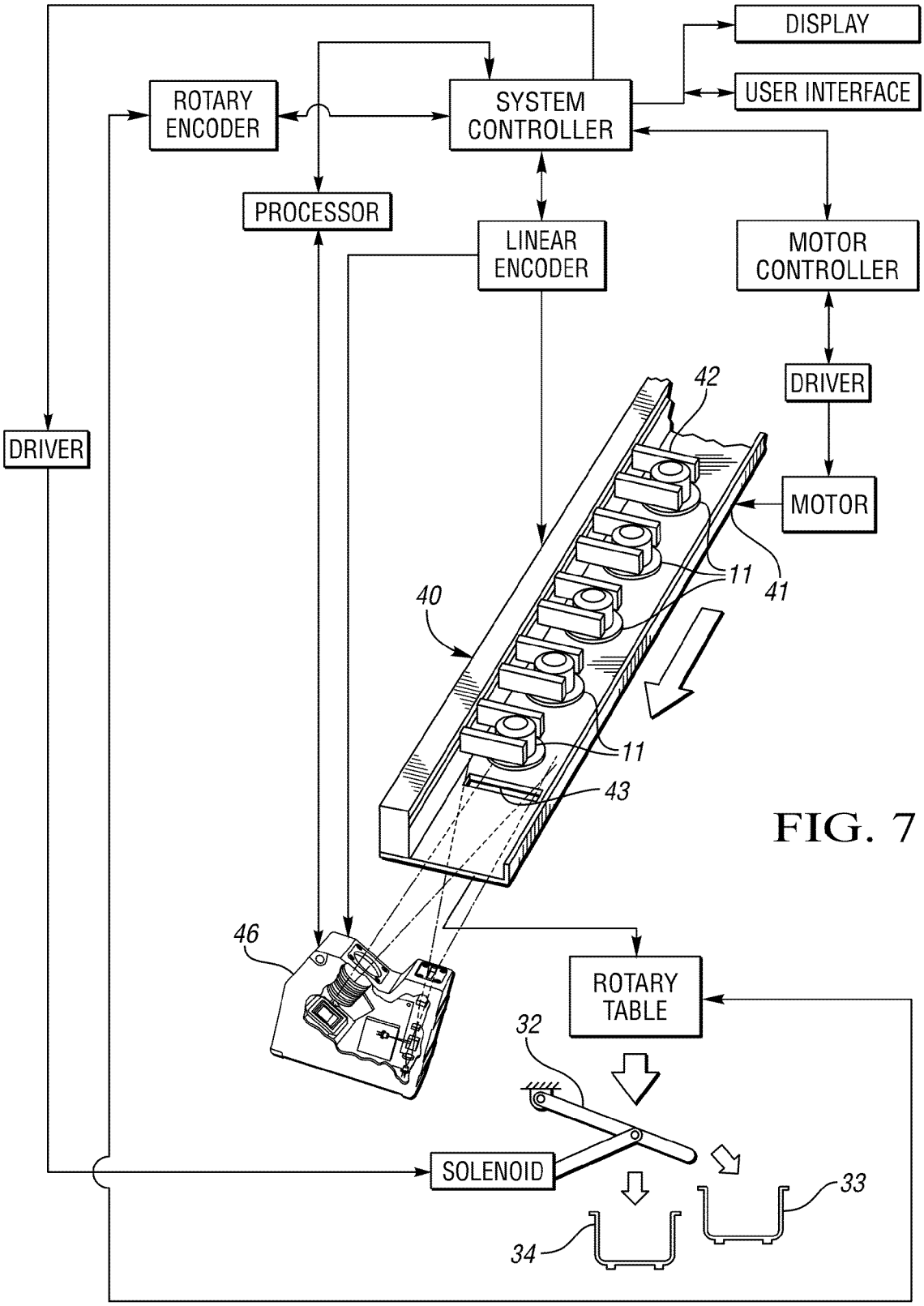
FIG. 7 is a schematic block diagram of the system of FIG. 1 at a bottom imaging station with the control system of FIG. 6.

The system 10 typically includes a part transfer subsystem including a transfer mechanism, generally indicated at 30 in FIG. 6, and/or a transfer mechanism, generally indicated at 40 in FIG. 7. Each mechanism 30 or 40 is adapted to receive and retain parts thereon at a loading station at which a loader loads parts to be inspected from the bowl 12 or other storage or transfer device. The transfer mechanism 40 may include a slotted, flat track 41 on which the parts 11 are conveyed at a bottom imaging station. The bottom imaging station typically includes a conveyor 42 or some linear motion "pusher" type actuator having a linear encoder coupled to the conveyor 42 to generate encoder signals and supply such signals to a sensor head 46 and to the system controller. A slot 43 of the track 41 is dimensioned to allow focused and reflected lines of radiation to pass therethrough but not allow the parts 11 to fall therethrough as described hereinbelow. The conveyor 42 may be a magnetic or vacuum conveyor for transferring parts to the transfer mechanism 30. Magnetic conveyors are frequently used to convey ferromagnetic articles, such as cans, stampings and the like. In conveyors of this type, permanent magnets are located in the frame of the conveyor beneath the conveying run of an endless belt and articles are attracted to the magnets so that the belt can travel along an incline or horizontal or vertical path of travel without the articles falling from the belt.

Alternatively, an indexing, beltless magnetic conveyor may be provided. Such a conveyor may include a housing defining a longitudinal length of the conveyor and a magnetic rack assembly moveably supported in the housing. The magnetic rack assembly includes a plurality of magnet assemblies supported at spaced intervals relative to one another along the longitudinal length of the conveyor. The beltless magnetic conveyor also includes a drive which is controlled by the system controller to index the magnetic rack assembly between a home or loading position proximate to one end of the housing and an end or inspection position which is proximate to an opposite end of the housing over the same path. The magnet assemblies are operable to generate a magnetic force which acts to attract ferromagnetic material toward the housing and to move the ferromagnetic material in the direction of the longitudinal length of the conveyor when the magnetic rack assembly is indexed.

The transfer mechanism 30 may be a rotating glass table or disk as shown in FIG. 6 to transfer the retained parts so that the parts travel along a first path which extends from a loader at a loading station to a top inspection or imaging station at which the parts have a predetermined position and orientation for optical inspection. Subsequently, the transfer mechanism 30 transfers the parts after imaging at the imaging station so that the inspected parts travel along a second path which extends from the imaging station to an unloader at an unloading station at which the inspected parts are unloaded from the transfer mechanism 30 by the unloader. The loader and unloader may be the same device, which can place parts which "pass" the inspection in a "good part" bin 33 and place parts which don't "pass" the inspection in a 'defective part" bin 34. The unloading station may be coincident with the loading station and the loading and unloading may be done manually or automatically.

The movable table or disk 30 may be a rotary index table or disk, for transferring parts at the top surfaces of the table 30. The table 30 is coupled to a rotary sensor or encoder which provides a control or encoder signal to the system controller and to a sensor head substantially identical to the sensor head 46 at the top imaging station at each of a plurality of known intervals of movement of the table 30. The control signals are utilized by the sensor head at the top imaging station as described hereinbelow. The rotary index table 30 typically has a central rotational axis 35 and an outer periphery which has a round shape. A rotary drive of the table 30 operates to rotate the index table 30 on a base for indexing rotation about the rotational axis 34 based on various sensor input signals from sensors to the system controller which, in turn, provides sequential control signals to a positioning drive mechanically coupled to the rotary drive. The system controller also provides control signals to a computer display and a part sorter or reject mechanism (for example, a solenoid-operated diverter or flipper 32 of FIG. 7). The rotary drive drives the index table 30 between inspection stations such as machine vision and eddy current stations.

The parts may be dropped onto the track 41 from the track 18. As the parts 11 move down and exit the track 41, they pass through the bottom imaging station to be inspected one at a time. The parts 11 which fail the inspection may be actively rejected by the part diverter or flipper 32. Parts which pass the inspection at the bottom imaging station are transferred to the rotary table 30 for top inspection.

A sensor head such as the sensor head 46 is located in both the top and bottom inspection stations. The sensor head is preferably a triangulation-based sensor head 46 supported and mounted within each of the top and bottom imaging stations. Each sensor head 46 illuminates either a top or bottom surface of each part 11 with focused planes or lines of radiation to obtain corresponding reflected lines when the part 11 is in the imaging station. The sensor heads 46 sense their corresponding reflected lines to obtain corresponding 2-D profile signals.

As the parts 11 move through the imaging stations, corresponding sets of 2-D profile signals are generated by the sensor heads 46. At least one processor processes the sets of 2-D profile signals to obtain a 3-D view of each top or bottom surface of the part 11.

The system controller provides control signals based on the signals from the linear and rotary sensors or encoders. Alternatively or additionally, the signals from the rotary and linear encoders are directly utilized by the sensor heads 46 at the top and bottom vision stations to control the sensor heads 46. The control signals are utilized to control the sensor heads 46 which preferably have encoder inputs which allow precise control over the position of 2-D profile signals samples.

At least one signal processor may process the sets of 2-D profile signals to identify a defective part as described in greater detail hereinbelow. The at least one processor may process the sets of 2-D profile signals to obtain one or more measurements of the part.

Each of the sensor heads 46 may comprise a high-speed, 2D/3D laser scanner (LJ-V7000 series) available from Keyence Corporation of Japan. Such a sensor head from Keyence generates a laser beam that has been expanded into a line and is reflected from the surface of the part. This reflected line of light is formed on a HSE3-CMOS sensor and by detecting changes in the position and shape of the reflection, it is possible to measure the position of various points along the surface of the part.

Such a sensor head 46 typically includes a cylindrical lens, at least one and preferably two semiconductor laser diodes, a GP64-Processor, a 2D Ernostar lens and a HSE3-CMOS sensor. Preferably, the laser diodes emit "blue" light beams which are polarized and combined by optical elements or components to form the line of laser light.

Preferably, the beams from the pair of blue laser diodes are combined such that the transmitted beam is polarized in both X and Y axes. The captured images at the sensor in both polarizations are used to generate a resulting 2-D profile signal wherein stray reflections are cancelled.

A comparison of such sensor heads 46 with 3-D measurement cameras reveal the following:

1. Easy Installation

When using a 3D camera, the laser light source and receiver (camera) are independent of each other, greatly complicating on-site installation and adjustment. With such sensor heads 46, the laser light source and receiver are contained in a single body or enclosure, making transmitter-to-receiver mounting adjustment unnecessary. This also ensures that the transmitter and receiver maintain this alignment regardless of machine use.

2. No Linearization Required

When using a 3D camera, the height of individual pixels and pixel pitch vary due to the relative positions of the laser light source and the receiver, requiring on-site linearization following installation. With such sensor heads 46, the output data is pre-linearized by the on-board controller (not shown) of the sensor head 46 without the need for additional post-processing.

3. Out of the Box Traceability

Because each such sensor head 46 is not a machine vision camera, but a traceable measurement device, traceability and calibration documentation is available out of the box. All such devices are factory calibrated to international traceability standards and compliance documentation is readily available.

The 2-D profile signals may be pre-processed by the on-board processor of the sensor head 46 and then processed by the at least one signal processor under system control to obtain a view or image which is used by the processor to determine at least one of a dent, a split, a perforation, a crack, a scratch, a wrinkle, a buckle, a bulge, and a surface blemish located at the end surfaces of the part.

The system 10 is an integrated system designed to fully inspect and measure parts at their ends at the top and bottom imaging stations. The system 10 can inspect parts which are supported on a track such as the track 41 which has the narrow slit 43 formed therein to allow an unobstructed view of the bottom end surface of the part 11.

Figure 10:
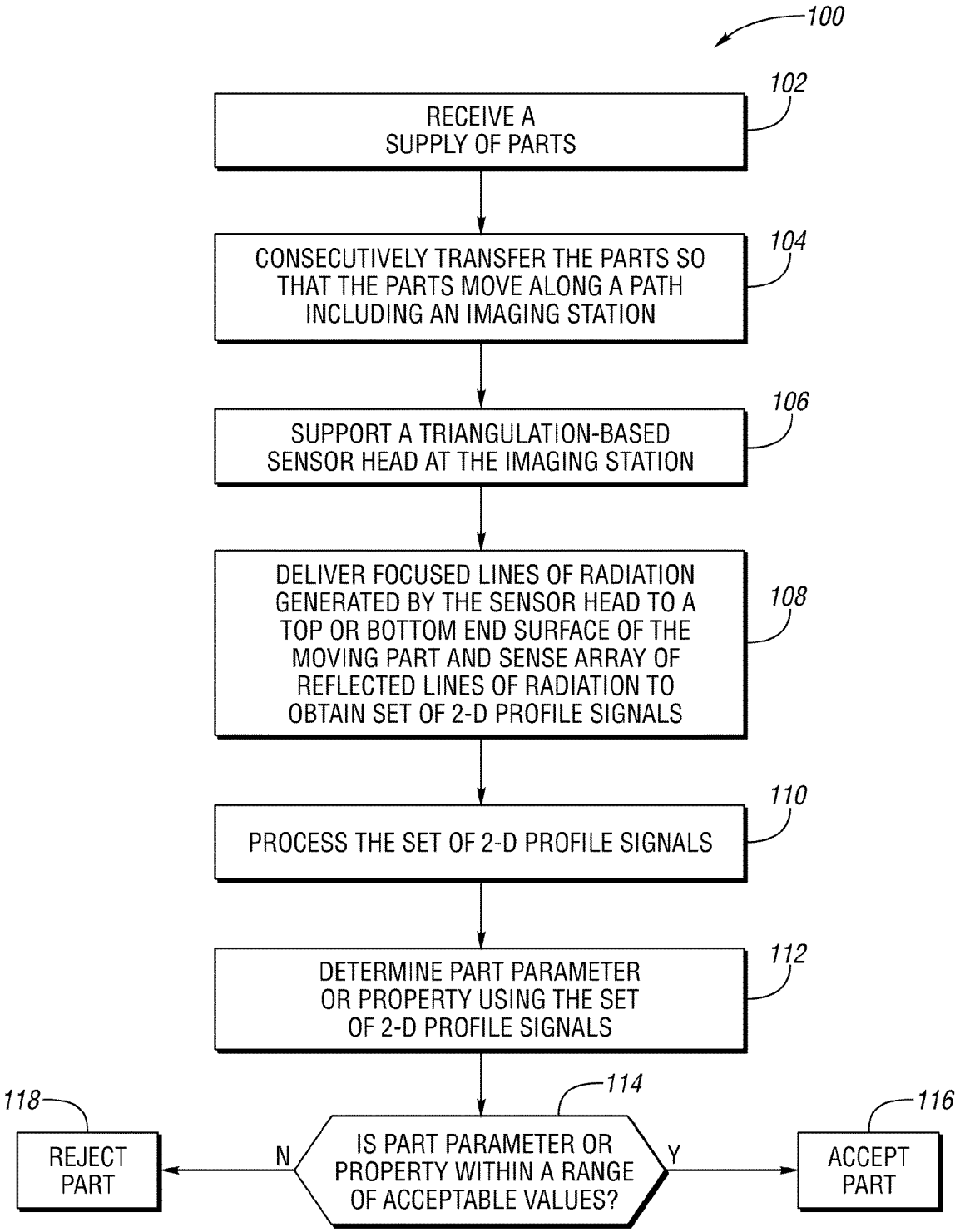
FIG. 10 is a block diagram flow chart illustrating a high-speed, high-resolution, triangulation-based, 3-D method of optically inspecting and sorting the inspected manufactured parts in accordance with at least one embodiment of the invention.

FIG. 10 is a detailed block diagram flow chart describing a method of at least one embodiment of the present invention, generally indicated at 100, as follows:

1. Receive a supply of parts such as ammunition caps (block 102);
2. Consecutively transfer the parts so that the parts move along a path including an imaging station (block 104);
3. Support a triangulation-based sensor head 46 at the imaging station (block 106);
4. Deliver focused lines of radiation generated by the sensor head 46 to an exterior end surface (i.e. top or bottom) of the moving part and sense arrays of the reflected lines of radiation to obtain a set of 2-D profile signals (block 108);
5. Process the set of 2-D profile signals (block 110);
6. Determine a part parameter or property using the set of 2-D profile signals (block 112);
7. Is part parameter or property within a range of acceptable values? (block 114);
8. If block 114 is "yes" accept part (block 116); and
9. If block 114 is "no" reject part as being defective (block 118).

A "reject mechanism" or unloader in the inspection and sorting system can be implemented in a number of equivalent known embodiments. For example, a "reject mechanism" could remove a nonconforming workpiece in a number of ways, by (i) routing the workpiece on a conveyor to a bin for nonconforming parts, (ii) mechanically displacing the workpiece from a conveyor into a bin, such as by a flipper or pusher device, (iii) magnetically displacing a (ferrous) workpiece by selective actuation of a magnet, (iv) pneumatically displacing the workpiece into a bin, such as by pressurized air, (v) using a robotic arm to pick up and remove the nonconforming workpiece, among other equivalent ways.

For example, a wide variety of reject mechanisms or reject gates are possible. The same gate can be used mechanically but software can be configured to allow the gate to be "RZ—return to zero" or "NRZ—non return to zero" modes. In RZ mode, the gate would stay shut and only open for good parts, then would return to zero for the good part signal. In NRZ mode the gate stays open and waits for the reject part signal, then would shut (return to zero) to reject the part, then open back up to wait for the next reject signal. In this way, the customer can choose which configuration to use. The dial table sorting machine can have multiple sensors that determine whether the part is accepted or rejected. The good parts are blown off into a good chute first. Then, the remaining parts are rejected by a wiper that simply stops the parts from continuing around the dial table, as the rejected part is wiped into the reject bin. Or, the customer can select the opposite, blow the reject parts off and allow the wiper to collect good parts.

One or More Signal Processors for the Detection of Surface Defects on Small Manufactured Parts The system 10 is especially designed for the inspection of relatively small manufactured parts. The processing of images and/or signals of the parts to detect defective parts begins after the sensor head 46 or probe projects a line of laser light onto the surface while the sensor camera continuously records the changing distance and shape of the laser line in three dimensions (XYZ) as it sweeps along the object.

Figure 8:
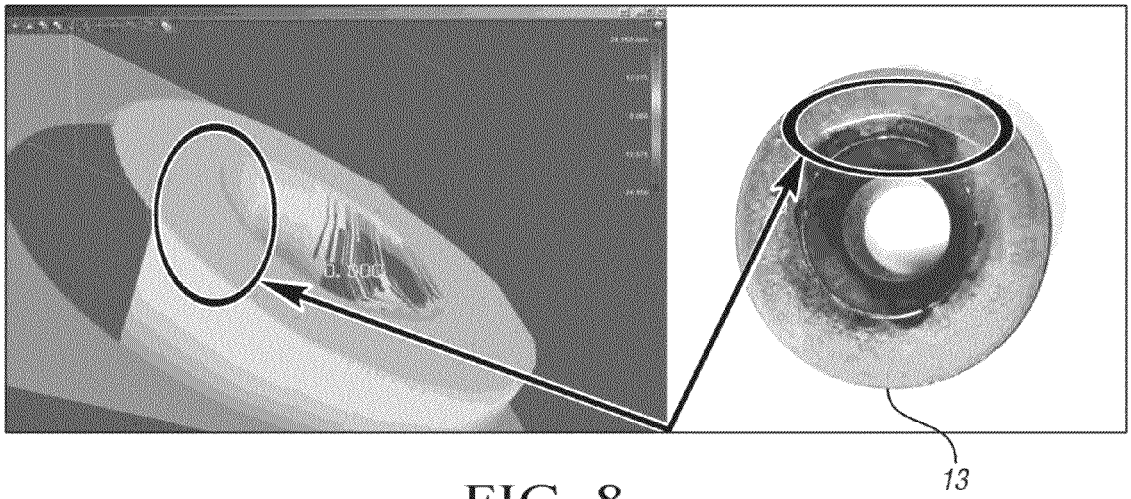
FIG. 8 is an image which shows a part with a surface defect (i.e. a dent) next to a photo realistic view of the part.
Figure 9:
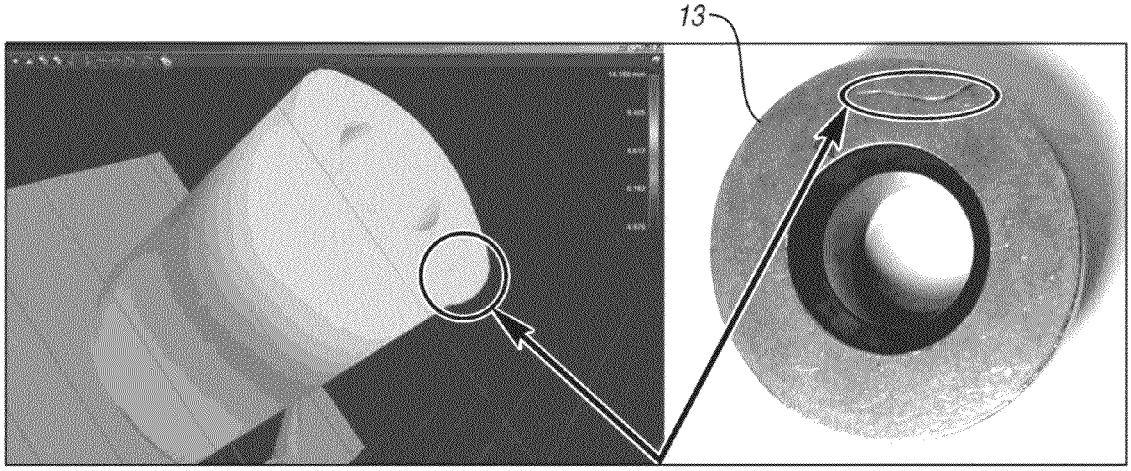
FIG. 9 is an image and view similar to the image and view, respectively, of FIG. 8 wherein the data is "zoomed in" to make the surface defect easier to see.

Referring now to FIGS. 8 and 9, the shape of the object or part appears as millions of points called a "point cloud" on the computer monitor as the laser moves around capturing the entire end surface shape of the object. The process is very fast, gathering up to 750,000 points per second and very precise (to ±0.0005"). After the huge point cloud data files are created, they are registered and merged into one three-dimensional representation of the object and post-processed with various software packages suitable for the specific application. The scanned object can be compared to the designer's CAD nominal data. The result of this comparison process is delivered in the form of a "color map deviation report," which pictorially describes the differences between the scan data and the CAD data.

The image of FIG. 8 shows a part with a dent defect and what that defect looks like to the topography sensor head 46. The image of FIG. 9 shows how one can zoom in on the data from the topography sensor head 46 to make the dent defects easier to see.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A high-speed, high-resolution, triangulation-based, 3-D method of inspecting manufactured parts and sorting the inspected parts, the method comprising;

receiving a supply of parts;

consecutively transferring the parts so that the parts move along a path which extends from the supply of parts and through an imaging station;

supporting a triangulation-based sensor head at the imaging station, the sensor head being configured to generate focused lines of radiation and to sense corresponding reflected lines of radiation;

delivering the focused lines onto an end surface of each part during motion of the parts relative to the focused lines to obtain a corresponding array of reflected lines of radiation, the sensor head sensing the array of reflected lines to obtain a corresponding set of 2-D profile signals, the set of profile signals representing a 3-D view of the end surface;

processing the set of 2-D profile signals of each part to identify parts having an unacceptable defect;

directing parts identified as having an unacceptable defect to a defective part area; and directing parts not identified as having an unacceptable defect to an acceptable part area.

2. The method as claimed in claim 1, further comprising generating control signals to control the sensor head based on the step of transferring.

3. The method as claimed in claim 1, wherein the sensor head includes at least one semiconductor laser.

4. The method as claimed in claim 1, wherein the focused lines of radiation are polarized laser lines of light.

5. The method as claimed in claim 1, wherein the step of processing determines a part parameter.

6. The method as claimed in claim 2, wherein the path is circular and wherein the step of generating is performed with a rotary encoder.

7. The method as claimed in claim 2, wherein the path is linear and wherein the step of generating is performed with a linear encoder.

8. The method as claimed in claim 1, further comprising the step of coordinating the imaging of the parts at the imaging station with the movement of the parts to and from the imaging station to control the movement and the imaging of the parts.

9. The method as claimed in claim 6, wherein the step of transferring is at least partially performed with a rotary glass disk or table.

10. The method as claimed in claim 7, wherein the step of transferring is at least partially performed with a track having an elongated slit dimensioned to allow the focused and reflected lines of radiation to pass therethrough.

11. A high-speed, high-resolution, triangulation-based, 3-D system for inspecting manufactured parts and sorting the inspected parts, the system comprising;

a source of parts;

a transfer subsystem for consecutively transferring the parts from the source of parts so that the parts move along a path which extends from the source of parts and through an imaging station;

a triangulation-based sensor head located at the imaging station, the sensor head being configured to generate focused lines of radiation and to sense corresponding reflected lines of radiation, the sensor head delivering the focused lines onto an end surface of each part during motion of the parts relative to the focused lines to obtain a corresponding array of reflected lines of radiation, the sensor head sensing the array of reflected lines to obtain a corresponding set of 2-D profile signals, the set of profile signals representing a 3-D view of the end surface;

at least one processor to process the set of 2-D profile signals of each part to identify parts having an unacceptable defect;

a mechanism including a part sorter for directing parts identified as having an unacceptable defect to a defective part area, and directing parts not identified as having an unacceptable defect to an acceptable part area; and a system controller coupled to the at least one processor and the part sorter to control the sorting based on the inspecting.

12. The system as claimed in claim 11, further comprising a sensor for providing a control signal at each of a plurality of known intervals of movement of the transfer subsystem, the control signals being utilized to control the sensor head.

13. The system as claimed in claim 11, wherein the sensor head includes at least one semiconductor laser.

14. The system as claimed in claim 11, wherein the focused lines of radiation are polarized laser lines of light.

15. The system as claimed in claim 11, wherein the at least one processor determines a part parameter.

16. The system as claimed in claim 12, wherein the path is circular and wherein the sensor is a rotary sensor.

17. The system as claimed in claim 12, wherein the path is linear and wherein the sensor is a linear sensor.

18. The system as claimed in claim 11, wherein the system controller coordinates the imaging of the parts at the imaging station with the movement of the parts to and from the imaging station to control the movement and the imaging of the parts.

19. The system as claimed in claim 16, wherein the transfer subsystem includes a rotary glass disk or table.

20. The system as claimed in claim 17, wherein the transfer subsystem includes a track having an elongated slit dimensioned to allow the focused and reflected lines of radiation to pass therethrough.

* * * * *